US007600618B2

(12) United States Patent
Fenton et al.

(10) Patent No.: US 7,600,618 B2
(45) Date of Patent: Oct. 13, 2009

(54) PIVOTABLE TOWING ARRANGEMENT

(75) Inventors: Timm John Fenton, Califon, NJ (US); Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 11/347,091

(22) Filed: Feb. 3, 2006

(65) Prior Publication Data

US 2007/0012536 A1 Jan. 18, 2007

Related U.S. Application Data

(63) Continuation-in-part of application No. 10/829,412, filed on Apr. 21, 2004.

(51) Int. Cl.
*A45C 13/26* (2006.01)
*A45C 5/14* (2006.01)

(52) U.S. Cl. ..... 190/39; 190/115; 16/113.1; 16/114.1; 280/655.1

(58) Field of Classification Search ..... 190/39, 190/115; 16/113.1, 114.1; 280/37, 655.1
See application file for complete search history.

(56) References Cited

U.S. PATENT DOCUMENTS

| | | | | |
|---|---|---|---|---|
| 1,616,632 | A | 2/1927 | Saviour | |
| 4,062,429 | A | 12/1977 | Tabor et al. | |
| 5,000,467 | A | 3/1991 | Becca | |
| 5,265,307 | A | 11/1993 | Hull et al. | |
| 5,339,934 | A | 8/1994 | Liang | |
| 5,353,900 | A | 10/1994 | Stilley | |
| 5,464,080 | A | 11/1995 | Liang | |
| 5,706,921 | A | 1/1998 | Wang | |
| 5,806,143 | A | 9/1998 | Tsai | |
| 5,890,570 | A | 4/1999 | Sadow | |
| 6,302,250 | B1 | 10/2001 | Sadow et al. | |
| 6,317,924 | B1 * | 11/2001 | Gallagher | 16/114.1 |
| 6,357,080 | B1 | 3/2002 | Tsai | |
| 6,434,790 | B1 | 8/2002 | Chen | |
| 6,470,533 | B1 | 10/2002 | Comstock | |
| 6,508,344 | B1 | 1/2003 | Lu | |
| 6,530,459 | B1 | 3/2003 | Lu | |
| 6,564,426 | B1 | 5/2003 | Wang | |
| 6,591,951 | B1 | 7/2003 | Chen | |
| 6,651,791 | B1 | 11/2003 | Nykoluk et al. | |
| 6,651,992 | B1 | 11/2003 | Smith, Sr. | |
| 6,668,423 | B1 | 12/2003 | Chen | |
| 6,892,866 | B2 * | 5/2005 | Wu | 190/115 |
| 6,898,823 | B2 * | 5/2005 | Tsai | 16/405 |
| 2002/0014382 | A1 | 2/2002 | Kuo | |
| 2002/0144874 | A1 | 10/2002 | Nykoluk et al. | |

(Continued)

FOREIGN PATENT DOCUMENTS

| | | |
|---|---|---|
| DE | 3636064 | 4/1988 |

(Continued)

*Primary Examiner*—Sue A Weaver
(74) *Attorney, Agent, or Firm*—Baker Botts L.L.P.

(57) ABSTRACT

A towing arrangement includes a pivotal handle which allows a user to position the handle more comfortably that would otherwise be possible with a conventional towing arrangement. The relative motion of the handle can also increase the maneuverability of a piece of luggage by eliminating the need for a person to reposition his or her hand on the handle when attempting to redirect the piece of luggage.

20 Claims, 6 Drawing Sheets

U.S. PATENT DOCUMENTS

| | | | | |
|---|---|---|---|---|
| 2003/0079950 | A1* | 5/2003 | Lin et al. | 190/115 |
| 2003/0085089 | A1* | 5/2003 | Lin et al. | 190/115 |
| 2003/0132080 | A1 | 7/2003 | Dababneh | |
| 2004/0181906 | A1* | 9/2004 | Kuo et al. | 16/114.1 |
| 2004/0182665 | A1 | 9/2004 | Scicluna et al. | |
| 2005/0016809 | A1 | 1/2005 | Wu | |
| 2005/0087415 | A1* | 4/2005 | Gorga et al. | 190/115 |
| 2005/0145459 | A1* | 7/2005 | Lu | 190/115 |
| 2005/0183914 | A1* | 8/2005 | Lin | 190/115 |
| 2006/0076203 | A1* | 4/2006 | Miller | 190/115 |

FOREIGN PATENT DOCUMENTS

| | | |
|---|---|---|
| FR | 2371178 | 6/1978 |
| WO | WO01/052687 | 7/2001 |

* cited by examiner

PIVOTABLE TOWING ARRANGEMENT

PRIORITY AND RELATED APPLICATION

This application is a continuation-in-part of U.S. patent application Ser. No. 10/829,412 filed Apr. 21, 2004 for "Pivotable Towing Arrangement," pending the disclosure of which is hereby incorporated by reference in its entirety.

FIELD OF THE INVENTION

This invention relates generally to towable travel luggage, and more particularly to a towing arrangement with a pivotal handle which allows a user to position the handle more comfortably than would otherwise be possible with a conventional towing arrangement.

BACKGROUND INFORMATION

Many varieties of luggage today come equipped with wheels from the manufacturer to enable a user to roll rather than carry or drag his or her luggage when traveling. Typically, such bags come equipped with a towing arrangement, which is sometimes simply a strap attached to the bag but is more often a handle attached to an extendable tubular member which is extended when the luggage is being towed. When the luggage is not being towed, the extendable tubular member is generally left in the retracted position, and thus generally does not affect the outer dimensions of the bag. The length of the tubular member is typically such that it prevents the luggage from coming into contact with the user's legs and feet while it is extended and the luggage is being towed.

The typical conventional towing arrangement is depicted in FIG. 1. A piece of luggage 110 includes two telescoping poles 116, connected by a towing handle 118, which slide into receptacles attached to the piece of luggage 110. This type of luggage generally also has a receptacle for the towing handle such that the towing handle lies flush with an exterior surface of the piece of luggage when the towing arrangement is retracted.

Extendable towing arrangements generally include a mechanism for locking the towing arrangement in the extended and in the retracted positions. Such mechanisms can include spring loaded detents, cam locks, and other interference locks and interference fits. Some mechanisms require manual operation of the release mechanism to extend and/or retract the tubular member. Some mechanisms are automatically released by a sufficient amount of force to extend and/or retract the tubular member.

Conventional towing arrangements have some drawbacks despite their convenience over simply carrying the piece of luggage. The positioning and shape of the towing handle of most towing arrangements can make towing a piece of luggage awkward and uncomfortable. This is primarily because the person towing the bag must tow the bag with his or her wrist turned to its extreme in either one direction or the other when gripping the towing handle. Thus, maneuverability of the luggage becomes limited by the person's ability to further twist his or her wrist.

SUMMARY OF THE INVENTION

One approach to overcoming the shortcomings of the prior art is disclosed in commonly assigned U.S. Pat. No. 6,857,512 filed on Mar. 20, 2003, entitled "Selectively Rotatable Handle Assembly for Towable Luggage," which is hereby incorporated by reference in its entirety. One of the objects of the present invention is to overcome the aforementioned problems and deficiencies and to provide further improvements to the invention disclosed in U.S. Pat. No. 6,857,512.

For example, an exemplary embodiment of the present invention provides a towing arrangement in which the handle can be pivotally connected to the tubular member. The relative motion between the handle and the tubular member can allow a person to tow the piece of luggage in a more comfortable position than in the prior art. This is because the person can grasp the handle with his or her wrist facing his or her waist, rather than facing the ground or the ceiling as with conventional towing arrangements. The relative motion can also increase the maneuverability of a piece of luggage by eliminating the need for a person to reposition his or her hand on the handle when attempting to redirect the piece of luggage. The relative motion that can allow the handle to be oriented so that a person gripping it has his or her wrist facing his or her waist, also can permit the handle to be rotated approximately 90 degrees from that direction when the towing arrangement is retracted for storage. This orientation may be preferred for the retracted position, because towing arrangements are generally placed immediately adjacent to an exterior surface of the luggage.

Figure 1:
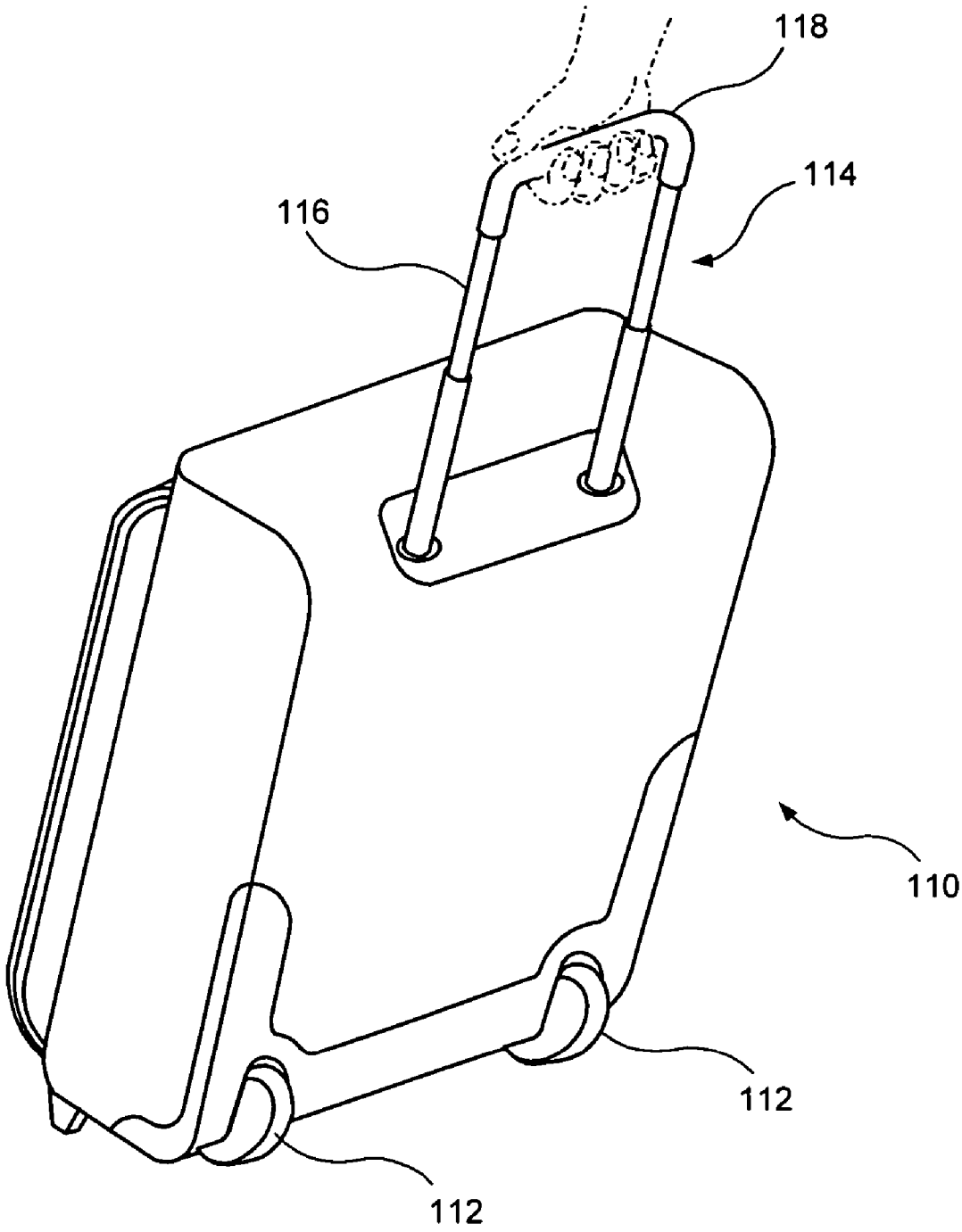
FIG. 1 PRIOR ART
FIG. 1 shows an isometric view of a conventional towing arrangement.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF THE PREFERRED EMBODIMENTS

Figure 2:
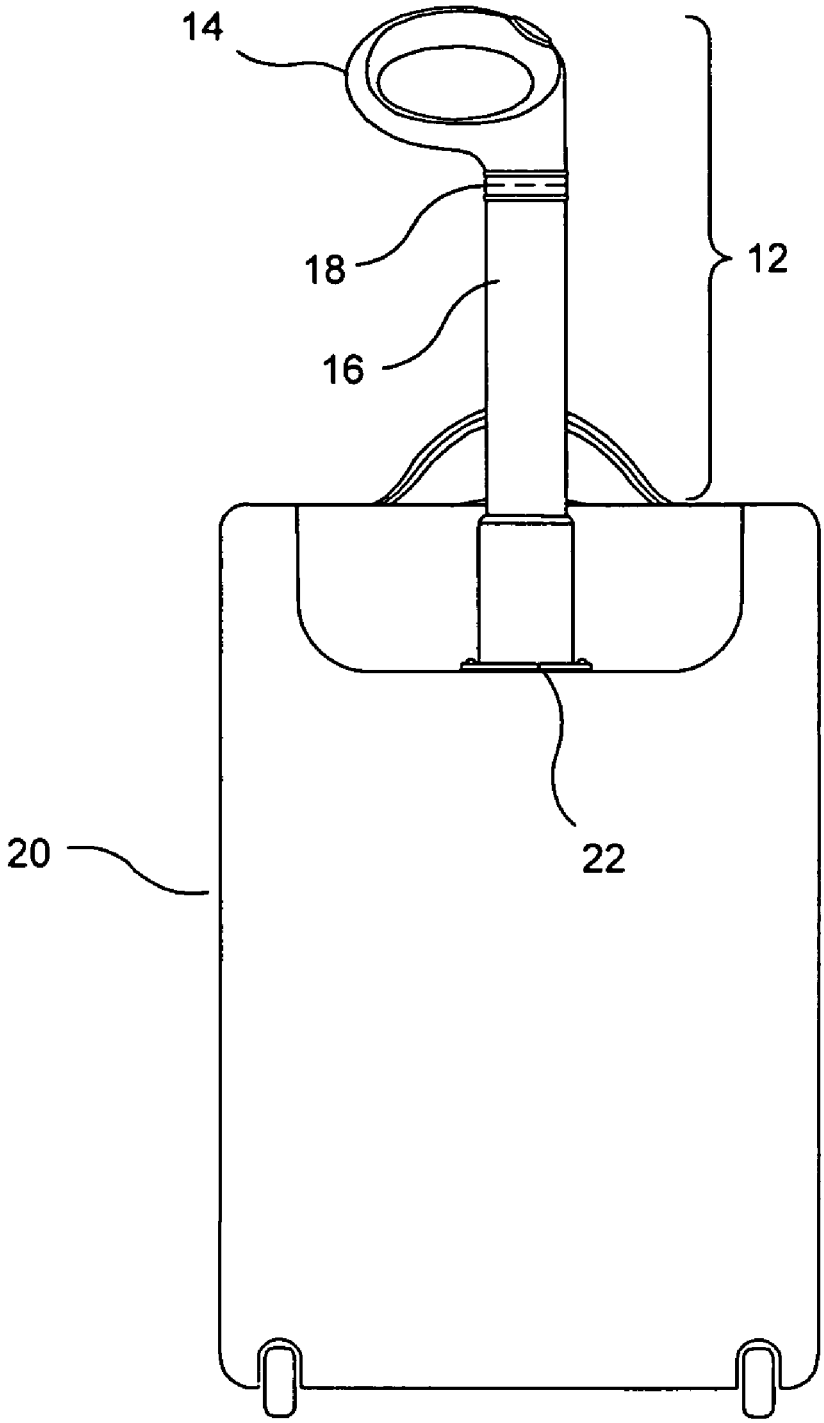
FIG. 2 shows an isometric view of a first exemplary embodiment of a towing arrangement according to the present invention.

FIG. 2 depicts an exemplary embodiment according to the present invention. A towing arrangement 12 may include a handle 14, a tubular member 16, and a handle mechanism 18. The towing arrangement 12 may be attached to a wheeled piece of luggage 20. The handle mechanism 18 may permit the handle to be rotated with the respect to the tubular member 16, and may also permit the tubular member 16 to retract into the luggage 20. The handle 14 may be of a generally oval shape. All of the individual components of the towing arrangement 12 may be fabricated from a material to provide sufficient strength, for example steel or aluminum. Optionally, the towing arrangement 12 may be attached to a cart used to transport a piece of luggage.

Figure 3:
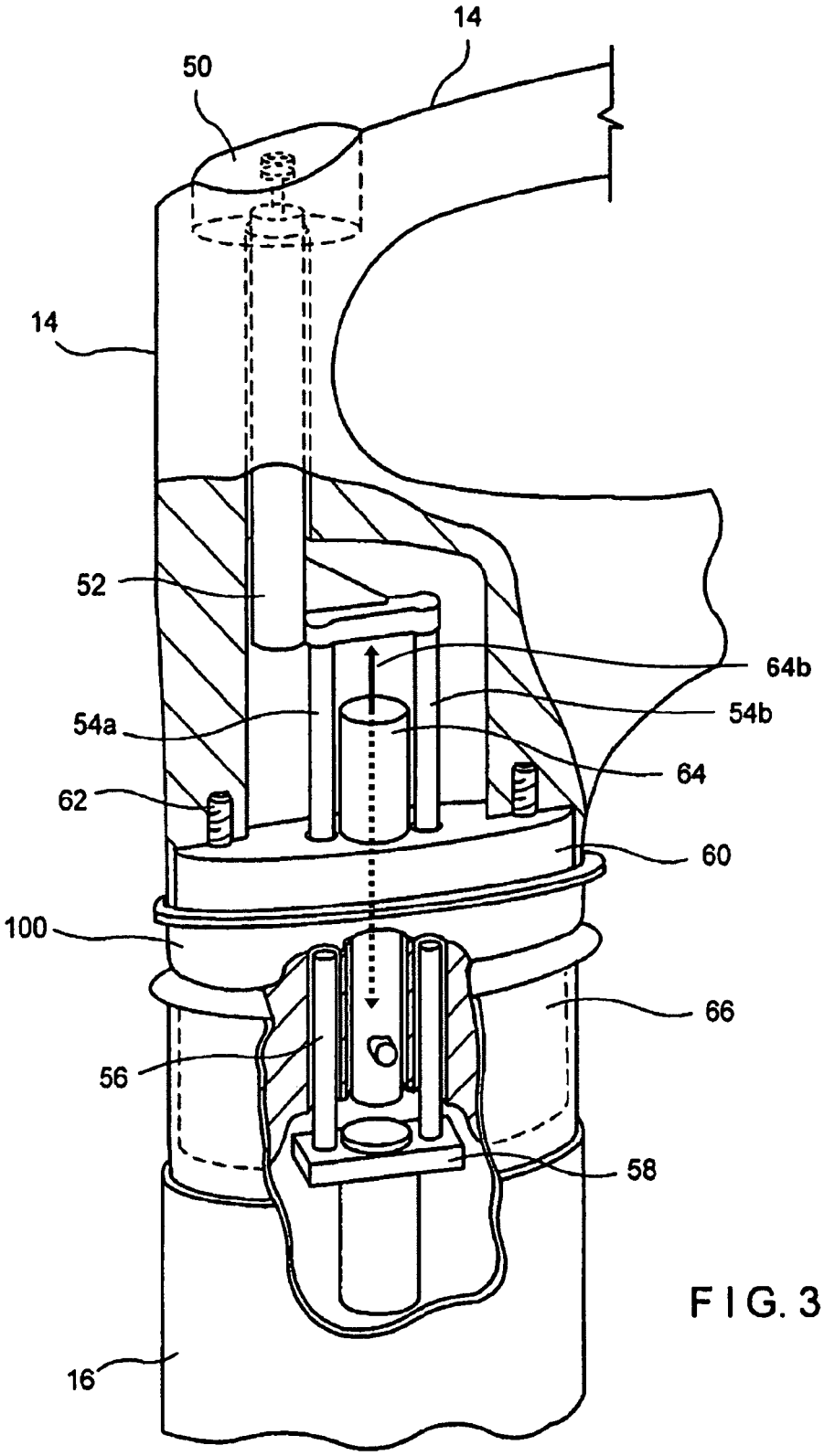
FIG. 3 shows a more detailed isometric view of the towing arrangement of FIG. 2.

FIG. 3 depicts a magnified and more detailed view than FIG. 2. A button 50 may be used to actuate a locking member 52 which may be in the passageway of the handle 14. The locking member 52 may include one or more first protrusions 54*a*, 54*b* which may communicate with second protrusions 56 of support locking member 58. In a preferred embodiment, only one first protrusion 54*a* is provided. The first protrusions 54 may pass through a coverback member 60. The coverback member 60 may be attached to the handle 14 via screws 62. A joint lock 64 may be used to permit rotation between the coverback member 60 and a joint member 66, while also preventing complete separation of the coverback member 60 and the joint member 66 in the direction of the axis of the joint member. The joint member 66 may be attached to the tubular member 16 by a press fit or via a pin connection. The joint member 66 also has a raised portion 110 which results in depressed end portions 110*a* and 110*b*.

Thus, because the coverback member 60 may be attached to the handle 14, and because the joint member 66 may be attached to the tubular member 16, the joint lock 64 may permit rotation of the handle 14 with respect to the tubular member 16 while also preventing complete separation of the handle 14 and the tubular member 16 in the direction of the axis of the joint member.

Figure 4:
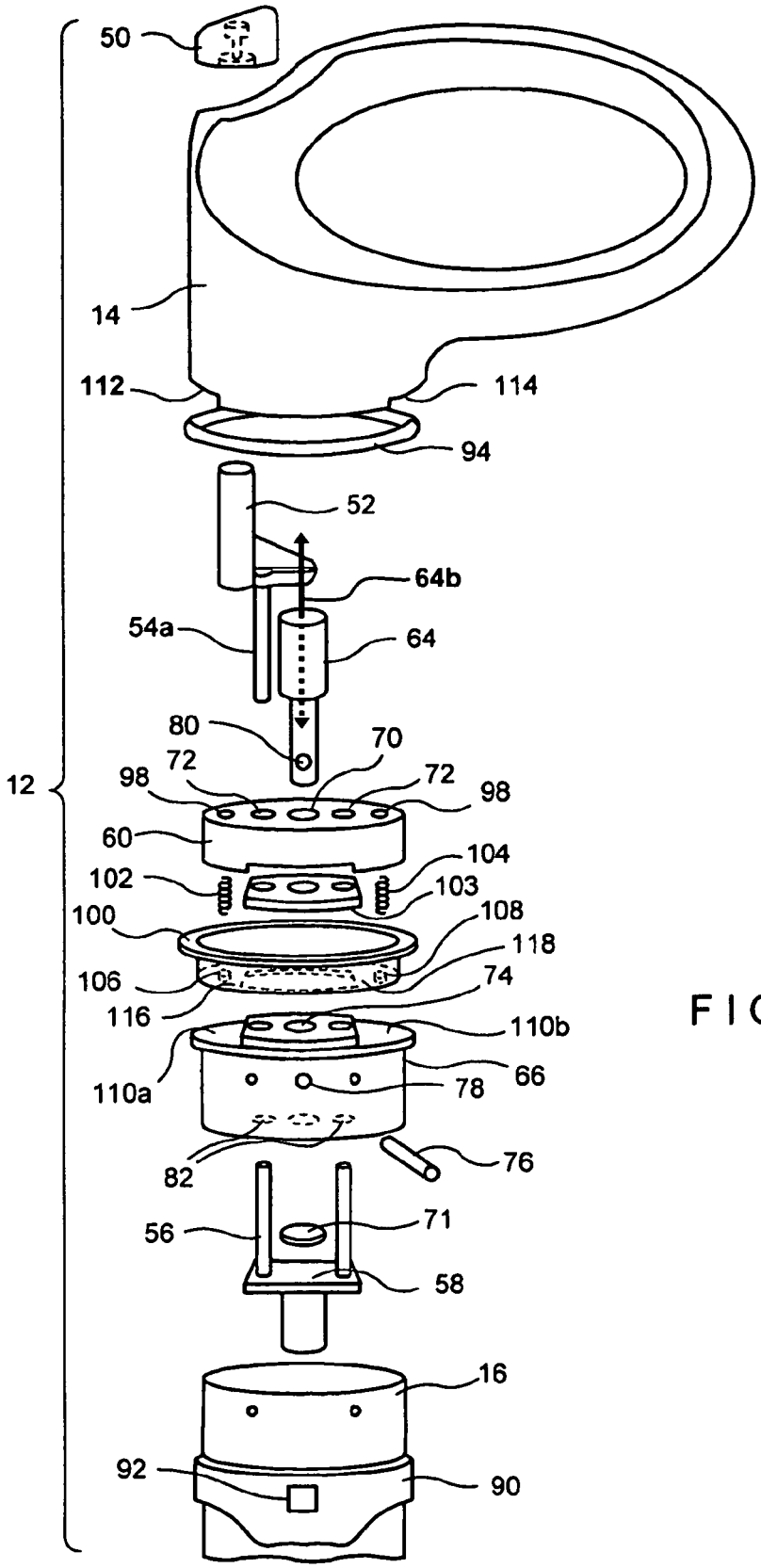
FIG. 4 shows an exploded view of certain components of the towing arrangement of FIG. 2.

As depicted in FIG. 4, the towing arrangement 12 may be assembled using the following steps. The joint lock 64 may be passed through a through-hole 70 of the coverback member 60. The first protrusion 54*a* of the locking member 52 may be placed in one of corresponding holes 72 in the coverback member 60. The coverback member 60 may be placed into one end of the handle 14 and may be attached thereto via screws (not shown) through holes 98. A button 50 may be placed into another end of the handle 14 and may be attached to the locking member 52 via a screw (not shown).

Figure 5:
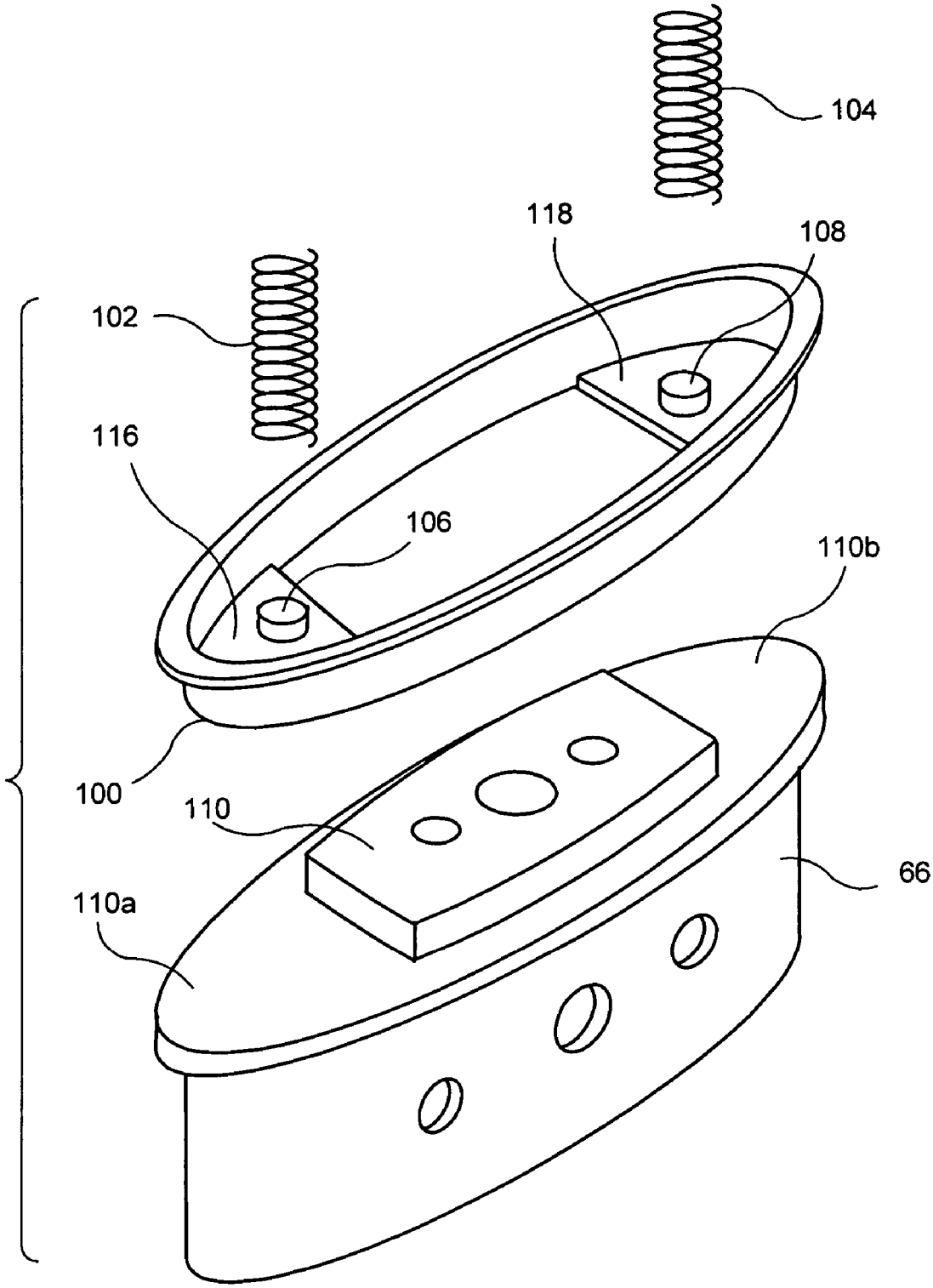
FIG. 5 shows a more detailed view an isometric view of certain components of the towing arrangement of FIG. 2.

A torsional locking member 100 may be placed over the coverback member 60 with two springs 102, 104 and a strengthening member 103 therebetween. The springs 102, 104 may rest on protrusions 106, 108 on internal ledges 116 and 118 of the base of the torsional locking member 100, as further depicted in FIG. 5. Referring back to FIG. 4, the handle 14 may include notches 112, 114 to provide clearance for the ledges 116 and 118 of the base of the torsional locking member 100 when the torsional locking member 100 is in a first position.

A wear plate 71 may be placed over the joint lock 64. The joint lock 64 may be placed in a through hole 74 of the joint member 66. The torsional locking member 100, especially the ledges 116 and 118, may cooperate with the raised portion 110 and the depressed portions 110*a* and 110*b* of the joint member 66 in order to permit or prevent rotation of the handle 14 relative to the tubular member 16. A pin 76 may be assembled though hole 78 in joint member 66 and pressed fit into hole 80 of joint lock 64. The pin 76 may prevent relative motion between the joint lock 64 and the joint member 66. The second protrusions 56 of the support locking member 58 may be passed through corresponding holes 82 in the joint member 66. The joint member 66 may be placed into one end of the tubular member 16 and may be attached thereto via a press fit or via pins. Other components related to the release mechanism are not shown and may be assembled in the tubular member 16 prior to the assembling of the joint member 66 thereto.

The release mechanism (not shown) may keep the support locking member 58 as far as it will fit into the joint member 66 in the direction of the handle 14 because of a spring force, for example, exerted in the release mechanism and will not extend into the coverback member 60. Thus, supporting locking member 58 does not prevent rotation of handle 14 relative to tubular member 16. The locking member 52 may be kept as far as it will fit into the handle 14 in the direction toward the button 50 by a spring, for example (not shown). Except when button 50 is depressed, no part of locking member 52 extends into joint member 66.

A latching member 90 may be slidably attached to the exterior of the tubular member 16 and may be used to fill a gap between the tubular member and the corresponding receptacle 22 in the piece of luggage the tubular member retracts into. The latching member 90 may include a hook feature 92 that keeps the latching member 90 near the top of the receptacle 22.

In operation, when the button 50 is activated, the force therefrom is transferred to the first protrusion 54*a* of the locking member 52, which may communicate with one of the second protrusions 56 of the support locking member 58. These protrusions 54*a*, 56 do not make contact through the axis 64*b* of the joint lock 64. The support locking member 58 may communicate with another release mechanism (not shown) to permit extension or retraction of the tubular member 16 from the wheeled piece of luggage 20.

Figure 6:
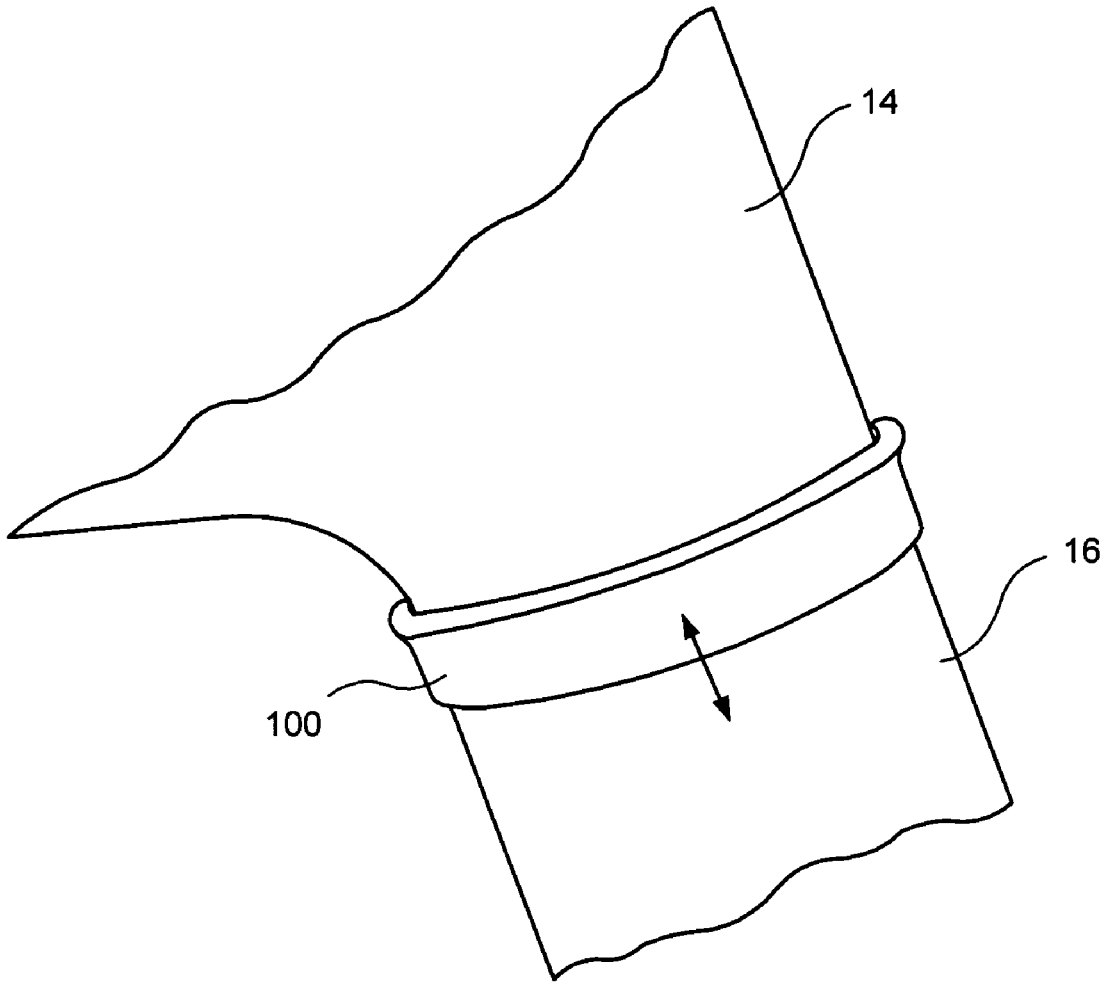
FIG. 6 shows an isometric view of the collar assembly that may be used with the towing arrangement of FIG. 2.

As shown in FIG. 6, the torsional locking member 100 may be used to prevent the towing arrangement from rotating, thus allowing ease of storage when the towing arrangement is placed in the retracted position. The torsional locking member 100 is slidably mounted on the coverback member 60 between a first position, at which a user slides the torsional locking member 100 against the force of the springs 102, 104 to move the torsional locking member 100 away from the raised portion 110 of the joint member 66 and thus permit rotation of the handle 14 relative to the tubular member 16, and a second position, at which the springs 102, 104 force the torsional locking member 100 to overlap the raised portion 110 of the joint member 66 and thus prevent rotation of the handle 14 relative to the tubular member 16. The strengthening member 103 may cooperate with the torsional locking member 100 during rotation of the handle 14, by adding rigidity to the torsional locking member 100. When the handle 14 is "aligned" with the tubular member 16 in either of two angular orientations (180 degrees apart from each other), the torsional locking member 100 (and thus the handle 14 and the tubular member 16) may automatically lock in place due to the force exerted by the springs 102, 104 in conjunction with the shape of the ledges 116, 118 of the base of the torsional locking member 100 and the raised portion 110 and depressed portions 110*a* and 110*b* of the joint member 66.

The foregoing merely illustrates the principles of the invention. Various modifications and alterations to the described embodiments will be apparent to those skilled in the art in view of the teachings herein. It will thus be appreciated that those skilled in the art will be able to devise numerous systems and methods which, although not explicitly shown or described herein, embody the principles of the invention and are thus within the spirit and scope of the invention.

What is claimed is:

1. A piece of towable luggage comprising:

a piece of luggage;

a tubular member adapted to be retractably mounted to a piece of luggage, the tubular member having first and second ends, the first end being adapted to be secured to the piece of luggage, the tubular member including an internal volume, the tubular member having an axis of elongation;

a handle which includes a passageway in communication with the tubular member internal volume, the handle being adapted to be rotatably connected to the tubular member at the second end, the handle being capable of rotating about the axis of elongation;

a joint lock member capable of rotatably connecting the handle to the tubular member;

a first member external to the joint lock member and adapted to be in communication with the of the handle and selectively in communication with the internal volume of the tubular member, wherein the entirety of the joint lock member is contained inside the first member; and a torsional locking member adapted to be in communication with the handle and the tubular member for movement between a first position, at which the torsional locking member permits rotation of the handle relative to the tubular member, and a second position, at which the torsional locking member prevents rotation of the handle relative to the tubular member;

wherein, the torsional locking member contains a return member that permits the torsional locking member to return automatically to the second position when the tubular member and the handle are in a first orientation.

2. The piece of towable luggage of claim 1 further comprising:

a further member, the further member being capable of cooperating with first member, the further member comprising a raised portion and a depressed portion;

wherein the raised and depressed portions of the further member are capable of cooperating with a cut-out portion of the torsional locking member;

wherein the torsional locking member further comprises a pair of features to locate a pair of springs, the pair of springs being capable of communicating with an other member to force the torsional locking member to the second position.

3. The piece of towable luggage of claim 2 wherein:

the first member comprises a pair of first protrusions capable of communicating with the internal volume, the pair of first protrusions being in line with and on opposite sides of the joint lock member; and further comprising a second member, the second member residing in the internal volume of the tubular member and including a pair of second protrusions capable of being aligned with the pair of first protrusions and, when so aligned, capable of being at least partially displaced along their axes by at least partial displacement of the pair of first protrusions.

4. The piece of towable luggage of claim 2 wherein:

the first member comprises at least a first protrusion capable of communicating with the internal volume and the towing arrangement further comprises a second member, the second member residing in the internal volume of the tubular member and including a pair of second protrusions capable of being aligned with the at least first protrusion and, when at least one of the pair of second protrusions is so aligned, capable of being at least partially displaced along their axes by at least partial displacement of the at least first protrusion; and further comprising a button in the handle in communication with the first member such that depressing the button at least partially displaces the first member towards the tubular member sufficient for a portion of the first member to be capable of extending into the internal volume of the tubular member;

wherein only when the at least first protrusion is aligned with at least one of the second protrusions, depressing the button in the handle at least partially displaces the first member towards the tubular member sufficient for a portion of the first member to extend into the internal volume of the tubular member;

wherein the tubular member is substantially symmetrical about a plane including the axis of the joint lock member and the cross-section of the tubular member orthogonal to the axis of the joint lock member is not circular.

5. The piece of towable luggage of claim 4 wherein the tubular member has a generally oval cross-section.

6. A towing arrangement for luggage comprising:

a tubular member adapted to be retractably mounted to a piece of luggage, the tubular member having first and second ends, the first end being adapted to be secured to the piece of luggage, the tubular member including an internal volume, the tubular member having an axis of elongation;

a handle which includes a passageway in communication with the tubular member internal volume, the handle being adapted to be rotatably connected to the tubular member at the second end, the handle being capable of rotating about the axis of elongation;

a joint lock member capable of rotatably connecting the handle to the tubular member;

a first member completely external to the joint lock member and adapted to be in communication with the passageway of the handle and selectively in communication with the internal volume of the tubular member, wherein the entirety of the joint lock member is contained inside the first member; and a torsional locking member adapted to be in communication with the handle and the tubular member for movement between a first position, at which the torsional locking member permits rotation of the handle relative to the tubular member, and a second position, at which the torsional locking member prevents rotation of the handle relative to the tubular member;

wherein, the torsional locking member contains a return member that permits the torsional locking member to return automatically to the second position when the tubular member and the handle are in a first orientation.

7. The towing arrangement of claim 6 further comprising a further member, the further member being disposed for cooperating with the first member, the further member comprising a raised portion and a depressed portion.

8. The towing arrangement of claim 7 wherein the raised and depressed portions of the further member are capable of cooperating with a cut-out portion of the torsional locking member.

9. The towing arrangement of claim 8 wherein the torsional locking member further comprises a pair of features to locate a pair of springs, the pair of springs being capable of communicating with an other member to force the torsional locking member to the second position.

10. The towing arrangement of claim 9 wherein the first member comprises at least a first protrusion capable of communicating with the internal volume and the towing arrangement further comprises a second member, the second member residing in the internal volume of the tubular member and including a pair of second protrusions disposed for alignment with the at least first protrusion and, when at least one of the pair of second protrusions is so aligned, capable of being at least partially displaced along their axes by at least partial displacement of the at least first protrusion.

11. The towing arrangement of claim 10 further comprising a button in the handle in communication with the first member such that depressing the button at least partially displaces the first member towards the tubular member sufficient for a portion of the first member to be capable of extending into the internal volume of the tubular member.

12. The towing arrangement of claim 11 wherein only when the at least first protrusion is aligned with at least one of the second protrusions, depressing the button in the handle at least partially displaces the first member towards the tubular member sufficient for a portion of the first member to extend into the internal volume of the tubular member.

13. The towing arrangement of claim 9 wherein the first member comprises a pair of first protrusions capable of communicating with the internal volume.

14. The towing arrangement of claim 13 wherein the pair of first protrusions are in line with and on opposite sides of the joint lock member.

15. The towing arrangement of claim 14 further comprising a second member, the second member residing in the internal volume of the tubular member and including a pair of second protrusions capable of being aligned with the pair of first protrusions and, when so aligned, capable of being at least partially displaced along their axes by at least partial displacement of the pair of first protrusions.

16. The towing arrangement of claim 12 wherein the joint lock member has an axis that is substantially parallel to the axis of elongation and tubular member is substantially symmetrical about a plane including the axis of the joint lock member and the cross-section of the tubular member orthogonal to the axis of the joint lock member is not circular.

17. The towing arrangement of claim 15 wherein the joint lock member has an axis that is substantially parallel to the axis of elongation and the tubular member is substantially symmetrical about a plane including the axis of the joint lock member and the cross-section of the tubular member orthogonal to the axis of the joint lock member is not circular.

18. The towing arrangement of claim 12 wherein the tubular member has a generally oval cross-section.

19. The towing arrangement of claim 16 wherein the tubular member has a generally oval cross-section.

20. The towing arrangement of claim 6 wherein the tubular member is a single-pole tubular member.

* * * * *